US010773921B2

(12) United States Patent
Nakanishi et al.

(10) Patent No.: US 10,773,921 B2
(45) Date of Patent: Sep. 15, 2020

(54) ATTACHMENT STRUCTURE FOR CORD REEL, AND APPARATUS INCLUDING CORD REEL AND HOLDER

(71) Applicant: Panasonic Intellectual Property Management Co., Ltd., Osaka (JP)

(72) Inventors: Kenta Nakanishi, Osaka (JP); Mitsuhiro Tosa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/295,355

(22) Filed: Mar. 7, 2019

(65) Prior Publication Data

US 2019/0276270 A1 Sep. 12, 2019

Related U.S. Application Data

(60) Provisional application No. 62/640,022, filed on Mar. 8, 2018.

(51) Int. Cl.
*B65H 75/42* (2006.01)
*B65H 75/44* (2006.01)

(52) U.S. Cl.
CPC ..... *B65H 75/4471* (2013.01); *B65H 75/4402* (2013.01); *B65H 75/4428* (2013.01)

(58) Field of Classification Search
CPC ..... B65H 75/446; B65H 75/4471; B65H 75/4428; B65H 75/4402; B65H 2701/3919
See application file for complete search history.

(56) References Cited

U.S. PATENT DOCUMENTS

| | | | | |
|---|---|---|---|---|
| 4,429,839 | A * | 2/1984 | Jessamine | B65H 75/4471 242/402 |
| 6,517,022 | B1 * | 2/2003 | Bailey | B65H 75/40 242/388.1 |
| 7,527,534 | B1 * | 5/2009 | Cheng | B65H 75/406 439/770 |
| 8,882,016 | B1 * | 11/2014 | Melvin | B65H 75/4431 242/395.1 |
| 10,230,200 | B1 * | 3/2019 | Tomasko | H01R 13/72 |
| 2003/0015617 | A1 * | 1/2003 | Chuang | B65H 54/585 242/395 |

(Continued)

FOREIGN PATENT DOCUMENTS

| | | |
|---|---|---|
| JP | 11-301932 | 11/1999 |
| JP | 2006-9912 | 1/2006 |

*Primary Examiner* — Sang K Kim
(74) *Attorney, Agent, or Firm* — Wenderoth, Lind & Ponack, L.L.P.

(57) ABSTRACT

A first engaging part is located on an outer surface of a cord reel and protrudes in a first direction orthogonal to a rotation axis of the cord reel. A second engaging part is located on the outer surface of the cord reel at a position different from the first engaging part in a second direction along the rotation axis. A holder base has an opening through which the cord reel can be inserted in the second direction. One or more notches are formed along the outer periphery of the opening of the holder base and allows the first engaging part to pass therethrough in the second direction. When the cord reel is attached to the holder, the holder base is disposed between the first engaging part and the second engaging part in the second direction.

16 Claims, 6 Drawing Sheets

(56) References Cited

U.S. PATENT DOCUMENTS

2013/0313352 A1* 11/2013 Alexandre ..... B65H 75/34
242/388
2018/0289915 A1* 10/2018 Rhyan ..... A61M 16/0672

* cited by examiner

ATTACHMENT STRUCTURE FOR CORD REEL, AND APPARATUS INCLUDING CORD REEL AND HOLDER

CROSS-REFERENCE TO RELATED APPLICATION

This application claims benefit to U.S. provisional application No. 62/640,022, filed on Mar. 8, 2018. The entire disclosure of U.S. provisional application 62/640,022 is hereby incorporated herein by reference.

BACKGROUND

Technical Field

The present disclosure relates to an attachment structure of a cord reel to a holder for mounting the cord reel, the cord reel being used for various types of cords such as cables for transmitting electric signals or the like, hoses, and wires.

Background Art

Handsets used by passengers for screen operations and the like in a mobile body such as aircrafts are known. The handset is removably housed in a cradle. A cord for transmitting electrical signals is connected to the handset, and a cord reel disposed in the cradle enables the cord to be wound and pulled out. Further, the cord reel is connected to a holder and fixed to a seat or the like.

BRIEF SUMMARY The present disclosure aims to provide an attachment structure in which a cord reel can be easily mounted to a holder.

The attachment structure for a cord reel according to the present disclosure is a structure for removably attaching to a holder a cord reel configured to rotate around a rotation axis to pull out or rewinding the cord. The attachment structure includes a first engaging part, a second engaging part, a holder base, and one or more notches. The first engaging part is located on an outer surface of the cord reel and protrudes in a first direction which is a direction orthogonal to the rotation axis. The second engaging part is located on the outer surface of the cord reel at a position different from the first engaging part in a second direction along the rotation axis. The holder base is located on the holder and has an opening into which the cord reel can be inserted in the second direction. The one or more notches are positioned along an outer periphery of the opening of the holder base and allow the first engaging part to pass through in the second direction. When the cord reel is attached to the holder, the holder base is disposed between the first engaging part and the second engaging part in the second direction.

An apparatus according to the present disclosure includes the above described attachment structure, a cord reel configured to rotate around a rotation axis enabling pulling out or rewinding of the cord, and a holder to which the cord reel is removably attached.

DETAILED DESCRIPTION

Hereinafter, exemplary embodiments will be described in detail with reference to the drawings as appropriate. However, a detailed description more than necessary may be omitted. For example, detailed description of already well-known matters and redundant description of configurations that are substantially the same may be omitted. This is to avoid the following description from being unnecessarily redundant and thus to facilitate understanding of the description by those skilled in the art.

It is to be noted that the attached drawings and the following description are provided to enable those skilled in the art to fully understand the present disclosure, and therefore they are not intended to restrict the subject matters of claims.

In the following description, a positive direction of an X axis corresponds to a direction in which the cord is pulled out from the cord reel. A Y axis is an axis orthogonal to the X axis in the same plane. A Z axis is an axis that is orthogonal to the X axis and the Y axis and is along the rotation axis of the cord reel. A positive direction of a Z axis corresponds to a direction in which the cord reel is removed from the holder, and a negative direction of the Z axis corresponds to a direction in which the cord reel is attached to the holder. Further, the Z axis positive side may be referred to as "upper side", and the Z axis negative side may be referred to as "lower side"; however, in the present disclosure, the upper and lower sides are not limited to the gravity direction.

1. First Exemplary Embodiment

A first exemplary embodiment will be described below with reference to FIGS. 1 to 6.

1-1. Configuration

Figure 1:
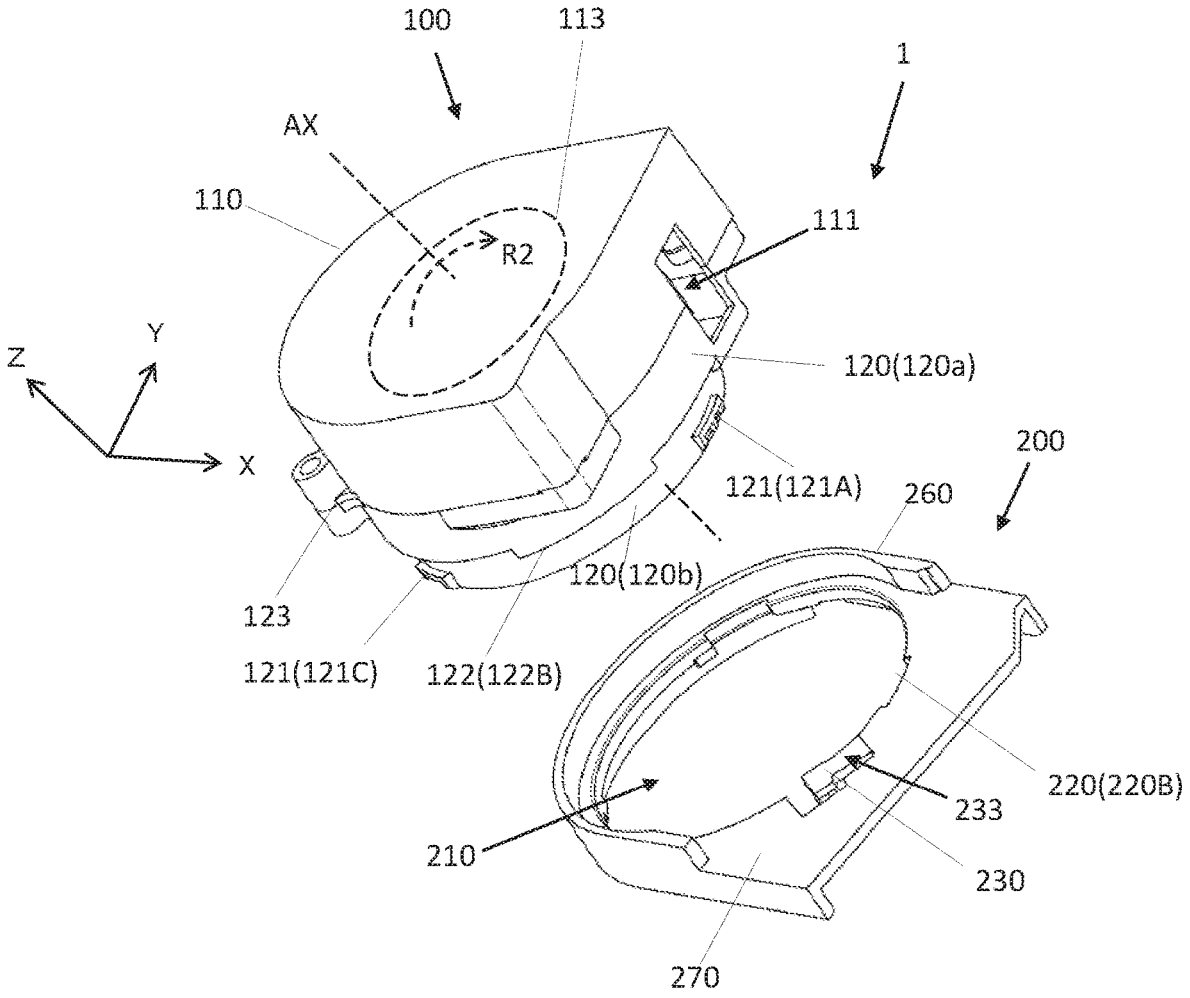
FIG. 1 is a perspective view of an apparatus including a cord reel and a holder according to a first exemplary embodiment.
Figure 2:
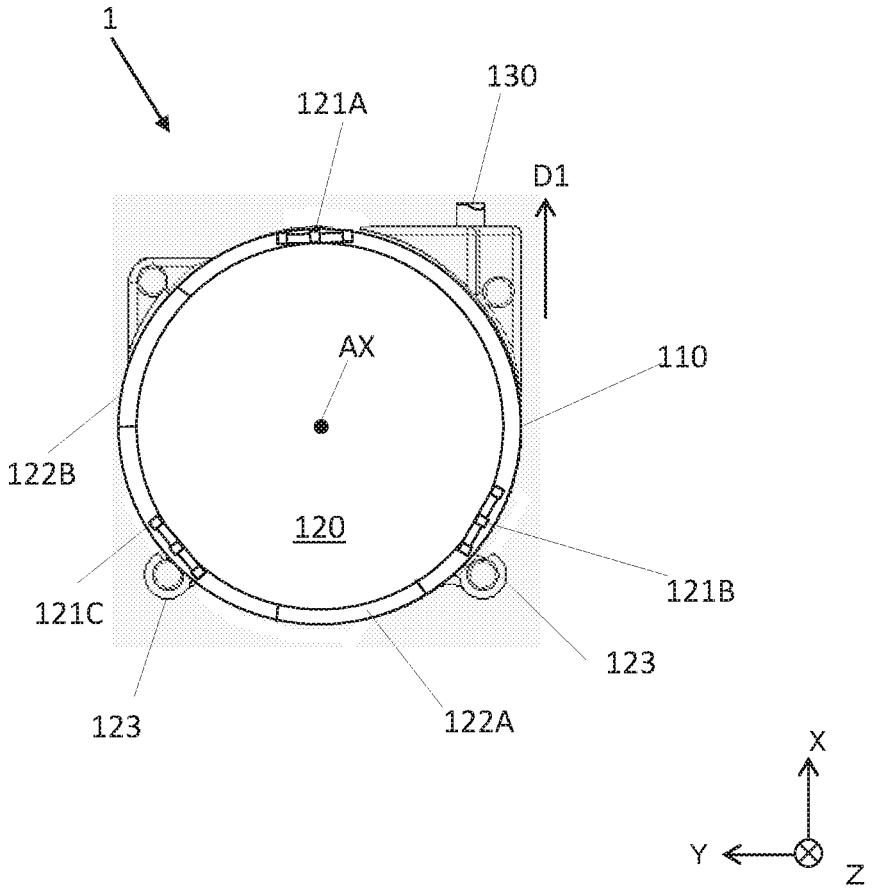
FIG. 2 is a plan view of the cord reel according to the first exemplary embodiment along an XY plane (lower side).

FIG. 1 is a perspective view of an apparatus 1 according to the first exemplary embodiment. FIG. 2 is a plan view of a cord reel 100 according to the first exemplary embodiment along an XY plane (lower side).

The apparatus 1 includes the cord reel 100 and a holder 200 to which the cord reel 100 is detachably attached.

1-1-1. Configuration of Cord Reel

A reel body 113 within the cord reel 100 rotates around a rotation axis C enabling pulling out or rewinding a cord 130 (FIG. 2) which is wound around the reel body 113. The cord reel 100 includes an upper housing 110, a lower housing 120, and the cord 130 wound around the reel body 113.

The upper housing 110 has a box-like shape that is partially arc-shaped. The lower housing 120 has a substantially cylindrical shape and is formed to have a smaller XY plane area than the upper housing 110. Given this configuration, when the cord reel 100 is inserted into the holder 200, the lower housing 120 of the cord reel 100 can be prevented from contacting a side wall rib 260 of the holder 200 to be described later.

The upper housing 110 has an opening 111 opened toward the positive side of the X axis. The location where the opening 111 is to be formed is not in the center of the cord reel 100 in the Y axis direction but near either the positive side or the negative side in the Y axis direction. For example, in FIG. 1, one end of the cord 130 is pulled out from the opening 111 when the reel body 113 inside the cord reel 100 rotates in a rotational direction R2. For this reason, the opening 111 is located at a position close to the positive side of the Y axis of the cord reel 100.

The cord 130 is pulled out from the opening 111 of the upper housing 110 and is rewound back therein by the rotation of the reel body 113. The reel body 113 is biased by a spring or the like in a rotational direction opposite to the rotational direction R2. Other communication devices such as a handset connected to the cord 130 are where one end of the cord 130 withdrawn from the opening 111 is connected to. It is to be noted that although the illustration is omitted, the other end of the cord 130 is withdrawn from the upper housing 110 and connected to a power source or another communication device and fixed.

When a user uses a communication device such as a handset, the cord 130 is pulled causing the reel body 113 to rotate in the rotational direction R2 against the biasing force, whereby the cord 130 is pulled out from the cord reel 100. On the other hand, when the user releases the communication device, the reel body 113 is reversely rotated by the biasing force, and the cord 130 is rewound into the reel body 113.

The lower housing 120 further includes, on the outer surface, three first engaging projections 121 (121A to 121C) for detachment prevention and two second engaging projections 122 (122A and 122B) for rotation prevention. Each of the first engaging projections 121 (an example of the first engaging part) protrudes in a direction (an example of a first direction) orthogonal to a rotation axis AX, that is, in the X axis direction or the Y axis direction. Each of the second engaging projections 122 (an example of the second engaging part) is formed at a different position from the first engaging projections 121 in the second direction along the rotation axis AX, that is, in the Z axis direction. The second engaging projections 122 are formed more to the positive side of the Z axis (upper side) than the first engaging projections 121. A lower end part 120*b* of the lower housing 120 is smaller in diameter than an upper end part 120*a* thereof. The second engaging projection 122 protruding in the negative direction of the Z axis is formed by cutting out a portion of the large-diameter upper end part 120*a* in the positive direction of the Z axis. Such a configuration achieves downsizing of the entire cord reel 100.

The length of each second engaging projection 122 in the circumferential direction of the cord reel 100 is longer than that of each of the first engaging projections 121.

As illustrated in FIG. 1, the cord reel 100 may further include a projection 123 located on the outer surface of the cord reel 100 for fixing the upper housing 110 and the lower housing 120 together.

1-1-2. Configuration of Holder

Figure 3:
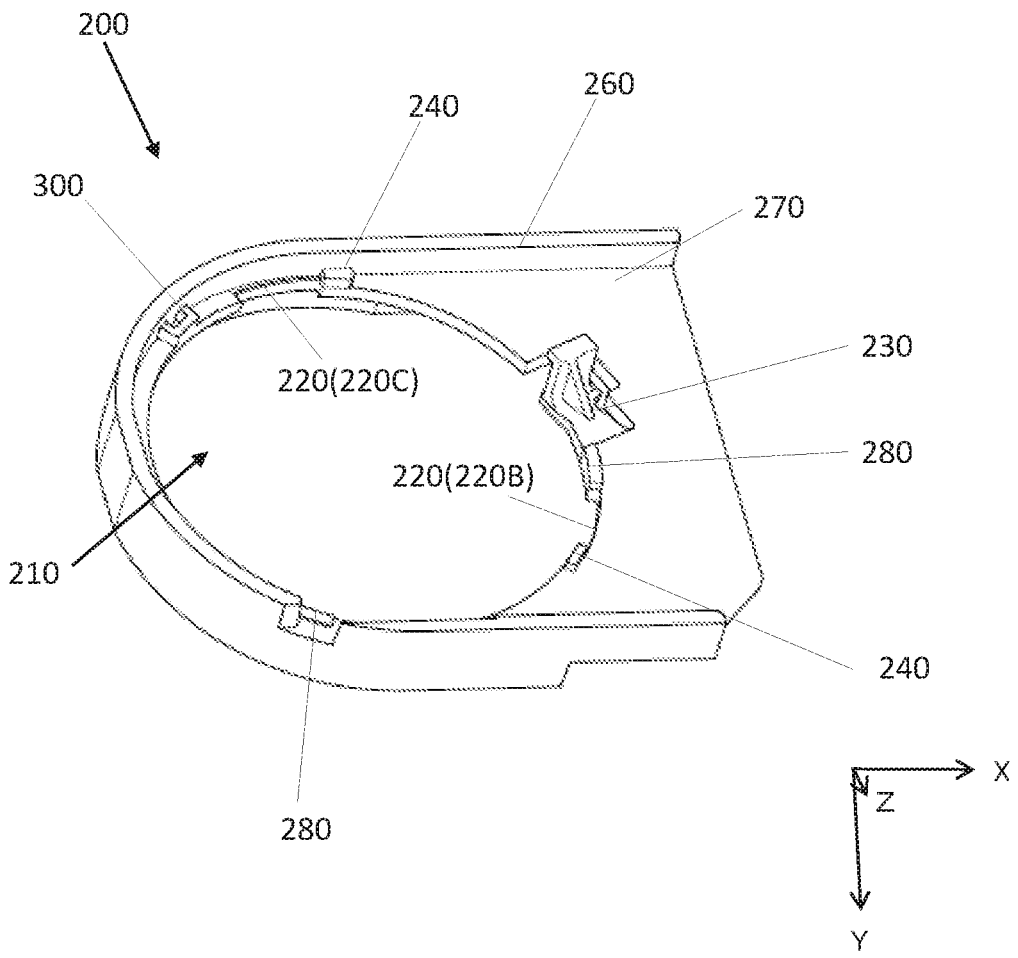
FIG. 3 is a perspective view of a lower side of the holder according to the first exemplary embodiment.
Figure 4:
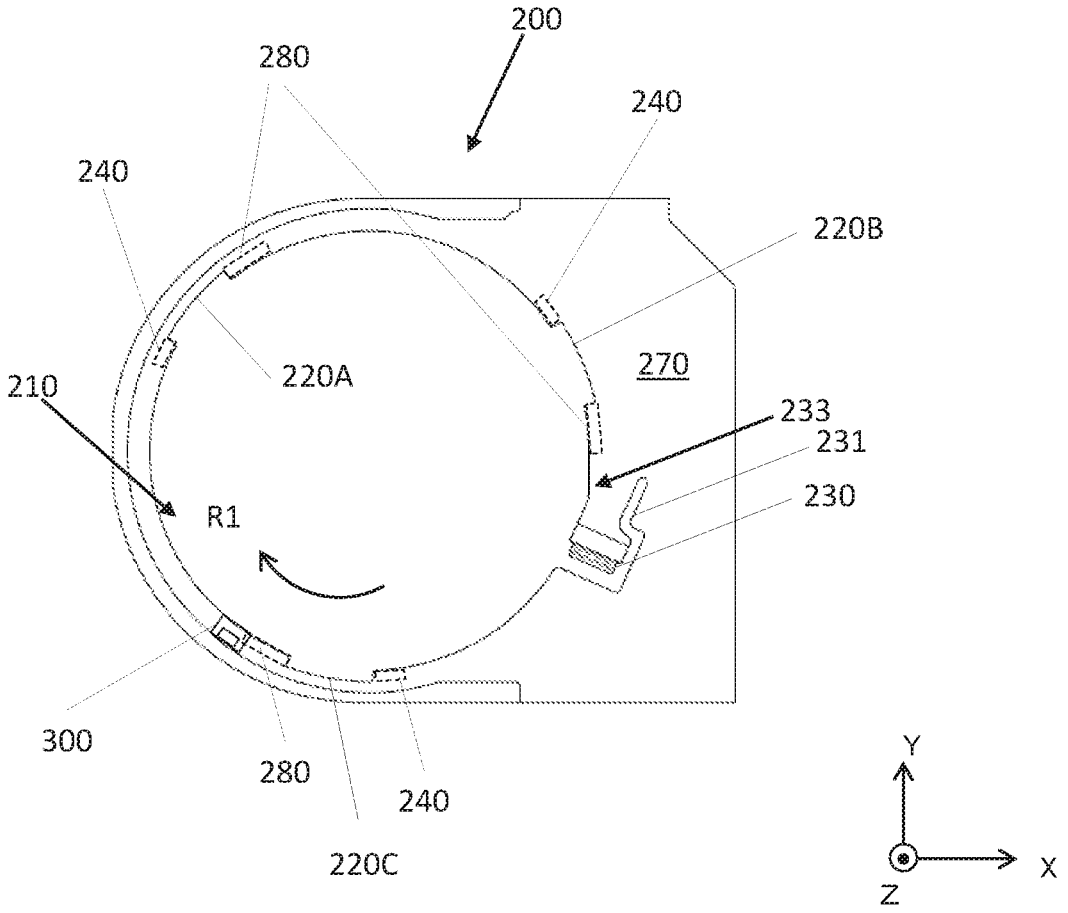
FIG. 4 is a plan view of the holder according to the first exemplary embodiment along the XY plane (upper side).

FIG. 3 is a perspective view of the lower side of the holder 200 and FIG. 4 is a plan view of the upper side of the holder 200 according to the first exemplary embodiment.

The holder 200 includes a holder base 270 and a side wall rib 260 formed around the holder base 270. The holder base 270 includes an opening 210 and notches 220 (220A to 220C).

The opening 210 is formed so as to enable the cord reel 100 to be inserted in the Z axis direction.

Three notches 220A to 220C are located along the outer periphery of the opening 210 of the holder base 270 and are formed at positions where the first engaging projections 121A to 121C can pass through in the Z axis direction.

Each of the notches 220 is formed shorter than the second engaging projections 122 of the cord reel 100. Thus, this configuration prohibits the second engaging projections 122 but allows the first engaging projections 121 to pass through the notches 220 when the cord reel 100 is inserted into the opening 210.

When the cord reel 100 is attached to the holder 200, the holder base 270 is disposed between the first engaging projections 121A to 121C and the second engaging projections 122A and 122B in the Z axis direction.

The holder base 270 may include a rotation restriction protruding piece 230. As illustrated in FIG. 4, the rotation restriction protruding piece 230 (an example of a first rotation restricting part) is formed by a cut portion 231 which is formed by cutting out a part of the holder base 270 along the outer periphery of the opening 210, and protrudes toward the negative side of the Z axis of the holder base 270, that is, the lower side thereof. The rotation restriction protruding piece 230 is elastically deformable in the negative direction of the Z axis because of the cut portion 231. The rotation restriction protruding piece 230 includes an inclined surface 233 capable of guiding the second engaging projections 122. As will be described later, the rotation restriction protruding piece 230 restricts the rotation of the cord reel 100 with respect to the holder 200.

The holder base 270 may include a rotation restricting damper 300. The rotation restricting damper 300 (an example of a second rotation restricting part) is located on the outer periphery of the opening 210 of the holder base 270 and protrudes toward the negative side of the Z axis of the holder base 270, that is, the lower side thereof. As will be described later, the rotation restricting damper 300 restricts the rotation of the cord reel 100 with respect to the holder 200. The rotation restricting damper 300 may include an elastic member such as rubber or a spring supported by a holding portion (not shown in the drawings). As will be described later, the rotation restricting damper 300 can alleviate the impact generated by the rotational force applied when the cord of the cord reel 100 is pulled out.

The holder base 270 may include a thin rib 280. The thin rib 280 (an example of a first rib) is located on the outer periphery of the opening 210, and slightly protrudes toward the negative side of the Z axis of the holder base 270, that is, the lower side thereof. The protruding height of the thin rib 280 is formed sufficiently shorter than the height of each first engaging projections 121. As illustrated in FIG. 4, three thin ribs 280 are included and are disposed adjacent to one end side of the notches 220, respectively, along the outer periphery of the opening 210. Here, "one end side" is the edge of each notch 220 on the clockwise side when the holder 200 is viewed from the upper side as illustrated in FIG. 4. The thin ribs 280 are formed such that the end faces thereof in the Z axis direction have the same height. When the cord reel 100 is attached to the holder 200, each of the first engaging projection 121A to 121C rides on the corresponding thin rib 280 and abuts on the thin rib 280 in the Z axis direction. That is, the thin ribs 280 are held between the holder base 270 and the first engaging projections 121A to 121C. With this configuration, the engagement in the Z axis direction when the cord reel 100 is attached to the holder 200 is stabilized, whereby rattling of the cord reel 100 can be prevented.

The holder base 270 may include a detent rib 240. The detent rib 240 (an example of a second rib) protrudes on the outer periphery of the opening 210 toward the negative side of the Z axis of the holder base 270, that is, the lower side thereof. As illustrated in FIG. 4, three detent ribs 240 are included, and are disposed adjacent to the other end side of the notches 220, respectively, along the outer periphery of the opening 210. Here, the "other end side" is the edge of each notch 220 on the counterclockwise side when the holder 200 is viewed from the upper side as illustrated in FIG. 4. As will be described later, the detent rib 240 restricts the rotation of the cord reel 100 relative to the holder 200.

1-2. Operation

The attachment and detachment of the cord reel 100 and the holder 200 configured as described above will be described below.

1-2-1. Attaching Cord Reel to Holder

Figure 5A:
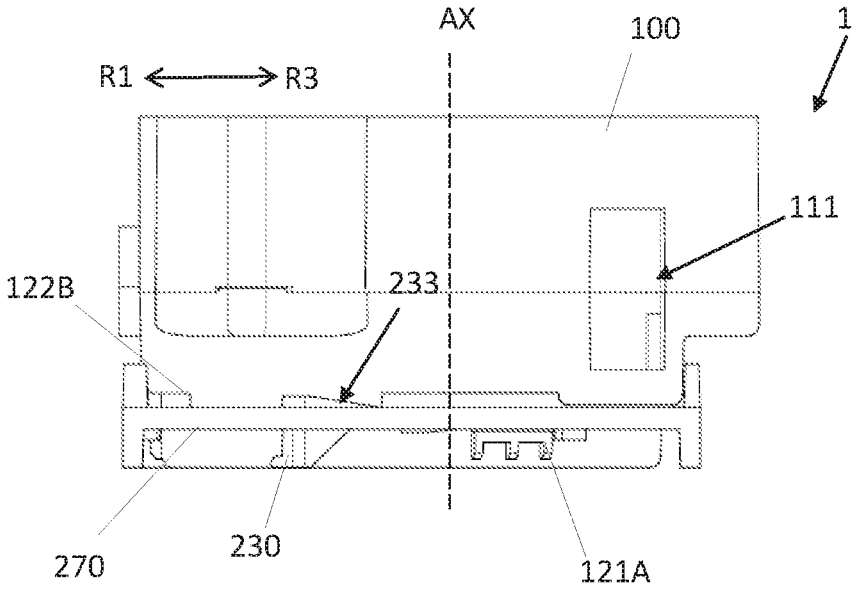
FIG. 5A is a side view of the apparatus in a state before attaching the cord reel to the holder according to the first exemplary embodiment.
Figure 5B:
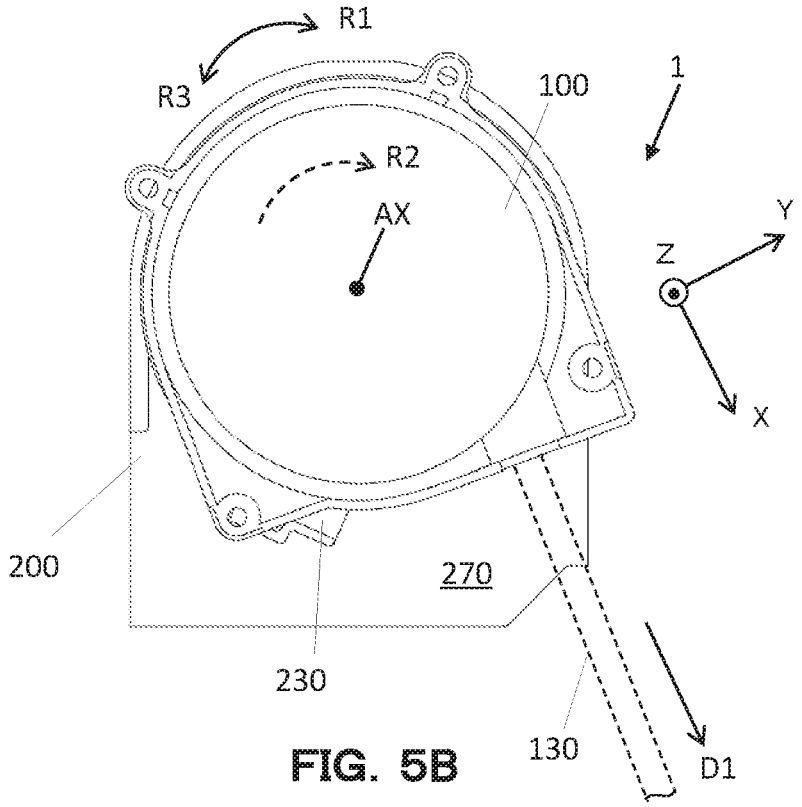
FIG. 5B is a plan view of the apparatus of FIG. 5A along the XY plane (upper side).

FIG. 5A is a side view illustrating a state of the apparatus 1 according to the first exemplary embodiment in which the cord reel 100 is inserted into the opening 210 of the holder 200 in order to attach the cord reel 100 to the holder 200. FIG. 5B is a plan view of the apparatus 1 of FIG. 5A along the XY plane (upper side).

An operator inserts the cord reel 100 into the opening 210 of the holder 200. At this point, the positions of the first engaging projections 121A to 121C of the cord reel 100 and the notches 220A to 220C of the opening 210 of the holder 200 are matched in the XY plane. This insertion renders the first engaging projections 121A to 121C to pass through the notches 220A to 220C and the second engaging projections 122A and 122B to abut on the holder base 270, thereby preventing further insertion. The result of this is, for example, the state as illustrated in FIG. 5.

When the insertion of the cord reel 100 into the holder 200 is completed, the cord reel 100 is rotated in a rotational direction R1 as illustrated in FIGS. 5A and 5B. Upon rotating the cord reel 100 in the rotational direction R1, the first engaging projections 121A to 121C are disengaged from the positions of the notches 220A to 220C, and the holder base 270 is sandwiched between the first engaging projections 121A to 121C and the second engaging projections 122A and 122B. At this time, as illustrated in FIG. 5A, the second engaging projection 122B is guided on the inclined surface 233 of the rotation restriction protruding piece 230, and with this guidance, the rotation restriction protruding piece 230 is elastically deformed by being pushed in the negative direction of the Z axis, that is, downward. At the same time, the cord reel 100 receives an urging force in the positive direction of the Z axis, that is, the upper side, due to the rotation restriction protruding piece 230, and thus the engaging force with the holder 200 is enhanced. As a result, the cord reel 100 is restricted from rotating in a rotational direction R3 (direction opposite to the rotational direction R1). On the other hand, at the position illustrated in FIG. 5A, the cord reel 100 is rotatable in the rotational direction R1.

Figure 6A:
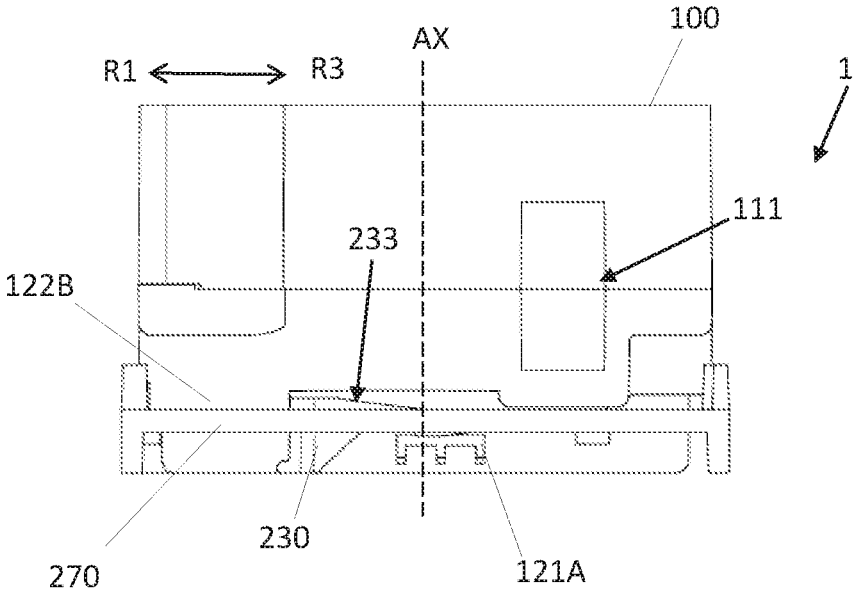
FIG. 6A is a side view of the apparatus in a state after attaching the cord reel to the holder according to the first exemplary embodiment.
Figure 6B:
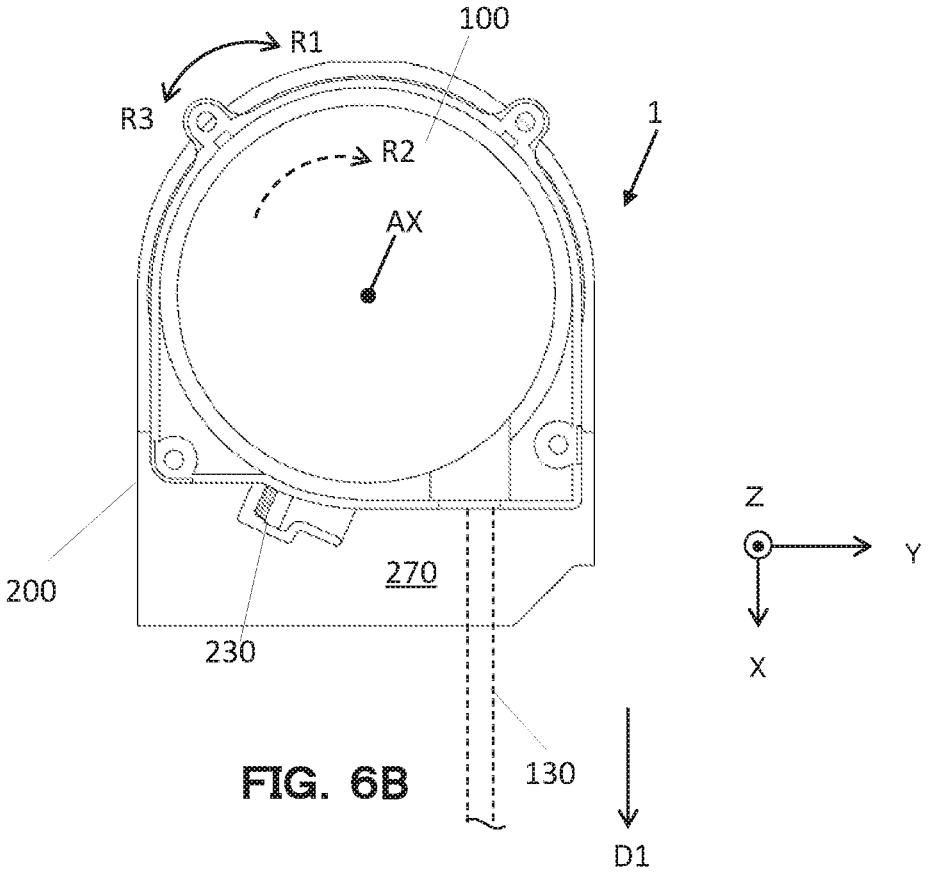
FIG. 6B is a plan view of the state of FIG. 6A along the XY plane (upper side).

When the cord reel 100 is further rotated in the rotational direction R1, the first engaging projections 121A to 121C ride on the thin ribs 280 (FIG. 4) located on the holder base 270. Thus, the cord reel 100 is restricted from moving in the Z axis direction and rattling with respect to the holder 200 is prevented. Also, at this time, the rotation of the cord reel 100 in the rotational direction R1 is restricted since the other first engaging projection 121C (FIG. 2) abuts the rotation restricting damper 300 (FIG. 4). Furthermore, as illustrated in FIG. 6A, the second engaging projection 122B passes over the rotation restriction protruding piece 230, and the rotation restriction protruding piece 230 elastically returns to the positive direction of the Z axis, that is, the upper side and abuts on the rear end of the second engaging projection 122B. The rotation of the cord reel 100 in the rotational direction R3 is thus restricted. As illustrated in FIGS. 6A and 6B, the cord reel 100 is locked to the holder 200 and the attachment is completed by means of the above operation.

1-2-2. Detaching Cord Reel from Holder

When releasing the locked state of the cord reel 100 attached to the holder 200, the operator first pushes the rotation restriction protruding piece 230 illustrated in FIGS. 6A and 6B in the negative direction of the Z axis, that is, downwards. The operator may then use an elongated tool such as a driver or tweezers. When the rotation restriction protruding piece 230 is pushed in the negative direction of the Z axis, the inclined surface 233 becomes substantially the same height as the holder base 270 in the XY plane which enables the code reel 100 to be rotated in the rotational direction R3. Upon rotating the cord reel 100 in the rotational direction R3, the first engaging projections 121A to 121C abut against the corresponding detent ribs 240 (refer to FIG. 4). At this point, the first engaging projections 121A to 121C and the notches 220A to 220C are at positions where they overlap in the Z axis direction. The cord reel 100 can be removed from the holder 200 when pulled in the positive direction of the Z axis.

Note that the protruding end of the rotation restriction protruding piece 230 is on the side opposite (lower side) to the attachment side of the cord reel 100. Therefore, when the cord reel 100 is locked to the holder 200 as illustrated in FIG. 6A and FIG. 6B, unintended unlocking caused by a worker's finger or the surrounding products/wirings can be prevented.

1-2-3. Operation of Code Reel

In the state where the cord reel 100 illustrated in FIGS. 6A and 6B is locked to the holder 200, the first engaging projection 121C (refer to FIG. 2) and the rotation restricting damper 300 (refer to FIG. 4) are in contact with each other without a gap therebetween. Therefore, when the cord 130 is pulled out in a D1 direction, the rotation restricting damper 300 is pushed and compressed by the first engaging projection 121C rendering the cord reel 100 to slightly rotate in the rotational direction R1. When the pull-out operation of the cord 130 is stopped, the cord reel 100 receives a force in the rotational direction R3 due to the elastic force of the rotation restricting damper 300 and is thereby returned to the locked state again. As described above, the cord reel 100 is elastically locked to the holder 200, and therefore it is possible to prevent the impact generated by the initial motion of pulling out the cord 130 or when the pulling out of the cord 130 is stopped from being transmitted directly to the cord 130.

Further, the rotational direction R1 for attaching the cord reel 100 to the holder 200 is the same as the rotational direction R2 of the cord reel 100 when the cord 130 is pulled out from the cord reel 100. With this configuration, the pull-out operation of the cord 130 restricts the cord reel 100 from rotating in the direction in which the locking is released; hence a stable attachment structure of the cord reel 100 can be realized.

1-3. Features and Other Benefits

In the attachment structure of the cord reel 100 to the holder 200 according to the present exemplary embodiment, the first engaging projections 121 and the second engaging projections 122 are located at different positions in the direction of the rotation axis AX of the cord reel 100, that is, the Z axis direction. When the cord reel 100 is attached to the holder 200, the holder base 270 is disposed between the first engaging projection 121 and the second engaging projection 122 in the Z axis direction. Thus, the cord reel 100 can be stably attached to the holder 200.

Further, in the present exemplary embodiment, a structure is achieved in which the cord reel 100 is rotated with respect to the holder 200 to lock the cord reel 100 to the holder 200 in the Z axis direction (attachment and detachment direction of the cord reel 100) and the rotational direction. Therefore, the cord reel 100 can be attached to the holder 200 without using a fastening part or a tool, and the time for attaching the cord reel 100 can be shortened. In addition, when employing the cord reel 100 in aircrafts, the loss of the fastening parts may lead to serious accidents such as affecting the operation of the aircraft. However, the attachment structure according to the present exemplary embodiment is capable of reducing the risk of losing the fastening parts.

2. Other Exemplary Embodiments (1) In the apparatus 1 according to the first exemplary embodiment, as illustrated in FIG. 1 and FIG. 3, the configuration is such that the rotation restriction protruding piece 230, the rotation restricting damper 300, the thin rib 280, the detent rib 240, and so forth are located on the lower side of the holder base 270, but the configuration is not limited thereto. A configuration may be adopted in which some or all these projections are located on the upper side of the holder base 270 as described in the specification and drawings of Provisional Application No. 62/640,022 on which the present application is based on. In this case, when the cord reel 100 is attached to the holder 200, the first engaging projections 121 are guided on the inclined surface 233 of the rotation restriction protruding piece 230, whereby the pressing force of the first engaging projections 121 causes the rotation restriction protruding piece 230 to elastically deform upward, that is, in the positive direction of the Z axis. The second engaging projections 122 abut against the rotation restricting damper 300, the thin rib 280, and the detent rib 240. The rotation restricting damper 300, the thin rib 280, and the detent rib 240 of the holder base 270, and the second engaging projections 122 in the cord reel 100 are respectively located at predetermined positions where attachment and detachment of the cord reel 100 and the holder 200 is possible as in the first exemplary embodiment.

The number and positions of the first engaging projections 121 and the second engaging projections 122 of the cord reel 100 are not limited, and may be more or less than those in the first exemplary embodiment. The notches 220, the rotation restriction protruding piece 230, the rotation restricting damper 300, the thin rib 280, and the detent rib 240 are also located in accordance with the number and positions of the engaging projections.

GENERAL INTERPRETATION OF TERMS

In understanding the scope of the present disclosure, the term "configured" as used herein to describe a component, section, or a part of a device includes hardware and/or software that is constructed and/or programmed to carry out the desired function.

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms "including," "having," and their derivatives. Also, the terms "part," "section," "portion," "member," or "element" when used in the singular can have the dual meaning of a single part or a plurality of parts. Also as used herein to describe the above embodiment(s), the following directional terms "forward", "rearward", "above", "downward", "vertical", "horizontal", "below" and "transverse" as well as any other similar directional terms refer to those directions of a device. The term "circumference" and its derivatives may include a distance or measurement around an outside or an inside of a circle, any other round shape, or any polygonal shape.

Terms that are expressed as "means-plus function" in the claims should include any structure that can be utilized to carry out the function of that part of the present disclosure. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected exemplary embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

REFERENCE SIGNS LIST

1 Apparatus
100 Cord Reel
110 Upper Housing
111 Opening
113 Reel Body
120 Lower Housing
120*a* Upper End Part
120*b* Lower End Part
121 (121A to C) First Engaging Projection
122 (122A
B) Second Engaging Projection
123 Projection

130 Cord
200 Holder
210 Opening
220 (220A to 220C) Notch
230 Rotation Restriction Protruding Piece
231 Cut Portion
233 Inclined Surface
240 Detent Rib
260 Side wall Rib
270 Holder Base
280 Thin Rib
300 Rotation Restricting Damper
AX Rotation Axis

What is claimed:

1. An attachment structure for removably attaching a cord reel to a holder, the cord reel configured to rotate about a rotation axis to pull out or rewind a cord, the attachment structure comprising:

a first engaging part located on an outer surface of the cord reel and protruding in a first direction that is a direction orthogonal to the rotation axis;

a second engaging part located on the outer surface of the cord reel at a position different from the first engaging part in a second direction along the rotation axis;

a holder base located on the holder and having an opening into which the cord reel is able to be inserted in the second direction; and at least one notch located along an outer periphery of the opening of the holder base and allowing the first engaging part to pass therethrough in the second direction; wherein the holder base is disposed in-between the first engaging part and the second engaging part in the second direction when the cord reel is attached to the holder.

2. The attachment structure according to claim 1, wherein a first rotation direction for attaching the cord reel to the holder is the same as a rotation direction of the cord reel when the cord is pulled out from the cord reel.

3. The attachment structure according to claim 2, further comprising a first rotation restricting part located along the outer periphery of the opening of the holder base and protruding in the second direction, the first rotation restricting part including an inclined surface capable of guiding the first engaging part or the second engaging part, wherein when the cord reel is attached to the holder, the first rotation restricting part restricts the rotation of the cord reel with respect to the holder in a second rotation direction opposite to the first rotation direction.

4. The attachment structure according to claim 3, wherein the first rotation restricting part is elastically deformable in the second direction.

5. The attachment structure according to claim 3, wherein the holder base has an upper side to which the cord reel is attached and a lower side opposite to the upper side, wherein the first rotation restricting part protrudes toward the lower side.

6. The attachment structure according to claim 2, further comprising a second rotation restricting part protruding on the outer periphery of the opening of the holder base and configured to restrict the rotation of the cord reel with respect to the holder in the first rotation direction.

7. The attachment structure according to claim 6, wherein the holder base has an upper side to which the cord reel is attached and a lower side opposite to the upper side, wherein the second rotation restricting part protrudes toward the lower side.

8. The attachment structure according to claim 6, wherein the second rotation restricting part includes an elastic member.

9. The attachment structure according to claim 1, wherein the holder base includes one or more first ribs protruding on the outer periphery of the opening, and when the cord reel is attached to the holder, the one or more first ribs abut against the first engaging part or the second engaging part in the second direction.

10. The attachment structure according to claim 9, wherein the one or more first ribs are disposed adjacent to one end side of the notch along the outer periphery of the opening.

11. The attachment structure according to claim 10, wherein the holder base includes one or more second ribs protruding on the outer periphery of the opening, and the one or more second ribs are disposed adjacent to an other end side of the notch along the outer periphery of the opening.

12. The attachment structure according to claim 11, wherein the one or more second ribs restricts rotation in the second rotational direction opposite to the first rotational direction for attaching the cord reel to the holder.

13. The attachment structure according to claim 11, wherein the holder base has an upper side to which the cord reel is attached and a lower side opposite to the upper side, wherein at least one of the one or more first ribs and the one or more second ribs protrudes toward the lower side.

14. The attachment structure according to claim 1, wherein the second engaging part is longer than the first engaging part in a circumferential direction of the cord reel.

15. The attachment structure according to claim 1, wherein the second engaging part is longer than the notch in a circumferential direction of the cord reel.

16. An apparatus comprising:

the attachment structure according to claim 1;

the cord reel configured to rotate around the rotation axis to pull out or rewinding the cord; and the holder to which the cord reel is removably attached.

* * * * *